US006240657B1

(12) United States Patent
Weber et al.

(10) Patent No.: US 6,240,657 B1
(45) Date of Patent: Jun. 5, 2001

(54) FOOTWEAR WITH REPLACEABLE EYELET EXTENDERS

(75) Inventors: Mark Weber, Aspen, CO (US); Jack Wang, Taichung (TW); Joseph J. Skaja; Thomas M Adams, both of San Antonio, TX (US)

(73) Assignee: In-Stride, Inc., San Antonio, TX (US)

( * ) Notice: Subject to any disclaimer, the term of this patent is extended or adjusted under 35 U.S.C. 154(b) by 0 days.

(21) Appl. No.: 09/336,644

(22) Filed: Jun. 18, 1999

(51) Int. Cl.[7] ..... A43C 11/00
(52) U.S. Cl. ..... 36/50.1; 24/714.8
(58) Field of Search ..... 36/50.1, 51; 24/714.6, 24/714.7, 714.8

(56) References Cited

U.S. PATENT DOCUMENTS 887,942 * 5/1908 Houghland .
1,505,430 * 8/1924 Roberts et al. .
1,995,243 * 3/1935 Clarke .
4,144,621 3/1979 Green ..... 24/73
4,597,198 7/1986 Schweitzer ..... 36/100
5,347,695 * 9/1994 Lopez Saiz .
5,359,790 * 11/1994 Iverson et al. .
5,526,585 6/1996 Brown et al. .
5,755,044 * 5/1998 Veylupek .
5,906,057 * 5/1999 Borsoi .
6,029,375 * 2/2000 Borel .

FOREIGN PATENT DOCUMENTS 2694683 2/1994 (FR) .

* cited by examiner

*Primary Examiner*—Ted Kavanaugh
(74) *Attorney, Agent, or Firm*—Akin, Gump, Strauss, Hauer & Feld, LLP

(57) ABSTRACT

Footwear comprising a sole, an upper, and a lace-binding system comprising a plurality of replaceable eyelet extenders. Replacing eyelet extenders, or components thereof, with others of a different color facilitates switching footwear from one color pattern to another. Replacing eyelet extenders, or components thereof, with others of a different length, flexibility, or elasticity facilitates modifying flexibility between eyelets and lace.

5 Claims, 4 Drawing Sheets

FOOTWEAR WITH REPLACEABLE EYELET EXTENDERS

FIELD OF THE INVENTION

The present invention relates to footwear having a lace-binding system with replaceable eyelet extenders.

BACKGROUND OF THE INVENTION

Various lace-binding systems (i.e., shoelace-binding systems) are in use for securing shoes to feet. All typical lace-binding systems require a wearer who is experiencing a need to adjust the level of shoe snugness to untie ends of the lace (i.e., the shoelace), loosen or tighten the lace, and then retie ends of the lace in order to adjust the level of shoe snugness. In other words, typical lace-binding systems are not homeostatic with regard to maintaining a comfortable level of shoe snugness. Instead, the capacity to adjust shoe snugness via the typical lace-binding system is absent unless ends of a lace of the lace-binding system are untied, the lace is loosened or tightened, and the ends are then retied at the desired level of shoe snugness. Unfortunately, the wearer of a shoe having a typical lace-binding system may have a need to adjust the level of shoe snugness several times during the course of a day in order to set snugness at a comfortable level. Consequently, in order to meet these needs, the wearer of a shoe having a typical lace-binding system may be required to go through the tedious exercise of untying and retying lace ends several times during the course of a day.

Discomfort in shoe snugness for a shoe secured with a typical lace-binding system is often related to inflexibility in the path length of the tied lace. For example, if a shoe wearer ties the lace ends of a typical lace-binding system so that the lace is at a snug tension (e.g., as is done by some wearers having only largely stationary activity in mind), constancy in the path length of the lace of the lace-binding system can mean that the snug tension may later become a very pressing tension (e.g., when the wearer attempts to engage in a brisk walk). In fact, the tension of lace in the lace-binding system may become a source of great discomfort as the wearer's foot swells during the course of a later brisk walk, possibly causing injury to the dorsal metatarsal phalangeal joints of the foot.

Depending on the activity of the shoe wearer, accommodation for constancy in the path length of lace in a lace-binding system may be required in order to maintain a comfortable level of shoe snugness. Nonetheless, in a typical lace-binding system, the capacity for accommodating constancy in the path length of tied lace is limited. Once the lace ends that pass through the uppermost eyelets are tied, the path length of the tied lace is set.

Not only may the maintenance of a comfortable level of shoe snugness be tedious, and not only may the capacity to accommodate constancy in the path length of lace be limited, other aspects of typical lace-binding systems have negative aesthetic consequences. These negative aesthetic consequences derive from the fact that, except for lace, components of a typical lace-binding system are not readily replaceable. While replacing a lace of one color (e.g., red) for a lace of another color (e.g., blue) may contribute to switching from one shoe color pattern to another, attempting to replace non-lace components (e.g., vamp sections) of a typical lace-binding system after manufacture of shoes is generally futile.

SUMMARY OF THE INVENTION

The present invention provides footwear having a lace-binding system with replaceable eyelet extenders. Since a replaceable eyelet extender of the lace-binding system can interpose between an eyelet and lace, each such eyelet extender can provide a measure of flexibility between an eyelet and a lace. This flexibility can help accommodate constancy in lace path length, so that a comfortable level of snugness, e.g., in shoe fit, can be maintained without requiring a wearer often to untie and retie lace ends. Furthermore, since the eyelet extenders (or components thereof) may be replaced with relative ease, modifying shoe color patterns by switching eyelet extenders (or components thereof) of one color for those of another color may also be accomplished with relative ease.

Despite the relatively small spatial significance of components of a lace-binding system with replaceable eyelet extenders, as provided by the present invention, the visual appeal of such components may be an important aesthetic consideration for a shoe or another article of manufacture having a lace-binding system. In shoes, for example, the color of a replaceable eyelet extender (or a component thereof) as provided by the present invention, may be integral to an overall color pattern of a schema for uniform dress of a team, a band, or a cheerleading squad. Furthermore, the replaceable character of such an eyelet extender (or a component thereof) may be key to switching from one color pattern (e.g., of a home-team schema) to another desired color pattern (e.g., of a visiting-team schema) without requiring the acquisition of another complete pair of shoes in order to achieve the other desired color pattern.

Since eyelet extenders (or components thereof) of a lace-binding system of footwear, as provided by the present invention, are replaceable, switching from one overall color pattern to another is facilitated. Replaceable eyelet extenders (or components thereof) of a lace-binding system with eyelet extenders, as provided by the present invention, also facilitate accommodating constancy in the path length of lace (by allowing modification of flexibility between eyelets and lace), helping maintain a comfortable level of snugness (e.g., in shoe fit).

In particular, the present invention provides footwear, comprising: a sole; an upper connected to the sole, the upper comprising a lateral vamp section and a medial vamp section and a plurality of eyelets in the vamp sections; and a lace-binding system for drawing the vamp sections together, the lace-binding system comprising a plurality of eyelet extenders, each of the eyelet extenders being positioned within one of the eyelets, the eyelet extender comprising a sub-eyelet section for removably retaining the eyelet extender within the eyelet, a supra-eyelet section having a passage therethrough for receiving a lace, and an eyelet-traversing section joining the sub-eyelet section and the supra-eyelet section.

The present invention also provides a method of introducing a color pattern in footwear having eyelets, but lacking both lace and eyelet extenders. The present invention also provides a method of introducing flexibility in such footwear. The method of introducing a color pattern comprises: placing eyelet extenders in the eyelets so that each eyelet extender is removably retained and oriented to receive lace; and threading lace through supra-eyelet sections of the eyelet extenders. The method of introducing flexibility for such footwear comprises: placing eyelet extenders in the eyelets so that each eyelet extender is removably retained and oriented to receive lace; and threading lace through supra-eyelet sections of the eyelet extenders.

The present invention also provides a method of modifying a color pattern in footwear having a lace-binding system that has eyelets and lace but lacks eyelet extenders, as well as a method of modifying flexibility between eyelets and lace in such footwear, the method of modifying a color pattern comprising: removing lace threaded through eyelets; placing eyelet extenders in the eyelets so that each eyelet extender is removably retained and oriented to receive lace; and threading lace through supra-eyelet sections of the eyelet extenders. The method of modifying flexibility between eyelets and lace in such footwear comprises: removing lace threaded through eyelets; placing eyelet extenders in the eyelets so that each eyelet extender is removably retained and oriented to receive lace; and threading lace through supra-eyelet sections of the eyelet extenders.

The present invention also provides a method of modifying a color pattern in footwear having a lace-binding system with replaceable eyelet extenders, as well as a method of modifying flexibility between eyelets and lace in such footwear, the method of modifying a color pattern comprising: removing lace threaded through eyelet extenders; removing one or more eyelet extenders in eyelets; replacing the one or more removed eyelet extenders in the eyelets with replacement eyelet extenders of colors different than the one or more removed eyelet extenders so that each replacement eyelet extender is removably retained in an eyelet and oriented to receive lace; and threading lace through supra-eyelet sections of the replacement eyelet extenders. The method of modifying flexibility between eyelets and lace in such footwear comprises: removing lace threaded through eyelet extenders; removing one or more eyelet extenders in eyelets; replacing the one or more removed eyelet extenders in the eyelets with replacement eyelet extenders of a different length, flexibility, or elasticity than the one or more removed eyelet extenders so that each replacement eyelet extender is removably retained in an eyelet and oriented to receive lace; and threading lace through supra-eyelet sections of the replacement eyelet extenders.

For either the method of modifying a color pattern or the method of modifying flexibility between eyelets and lace in footwear having a lace-binding system with replaceable eyelet extenders, the removing of a component of an eyelet extender in an eyelet is understood to remove the eyelet extender from the eyelet, and the replacement of an eyelet extender component to form an eyelet extender in an eyelet is understood to place a replacement eyelet extender in the eyelet. Accordingly, either the method of modifying a color pattern or the method of modifying flexibility between eyelets and lace in footwear having a lace-binding system with replaceable eyelet extenders may be accomplished using components of replaceable eyelet extenders.

The present invention also provides a lace-binding system comprising a lace from a first piece, an eyelet in a second piece, and an eyelet extender joining the lace from the first piece and the eyelet in the second piece, the eyelet extender comprising a sub-eyelet section, an eyelet traversing section, and a supra-eyelet section, wherein: the eyelet-traversing section joins at one end the sub-eyelet section; the eyelet-traversing section at an opposite end joins the supra-eyelet section; the sub-eyelet section comprises an anchor for removably retaining the eyelet extender in the second piece; the supra-eyelet section receives lace from the first piece; and drawing a length of the lace between the first piece and the eyelet extender acts to draw the second piece toward the first piece.

Other features and advantages of the invention will be apparent from the following description of preferred embodiments thereof, and from the claims.

DETAILED DESCRIPTION OF THE INVENTION

Figure 1:
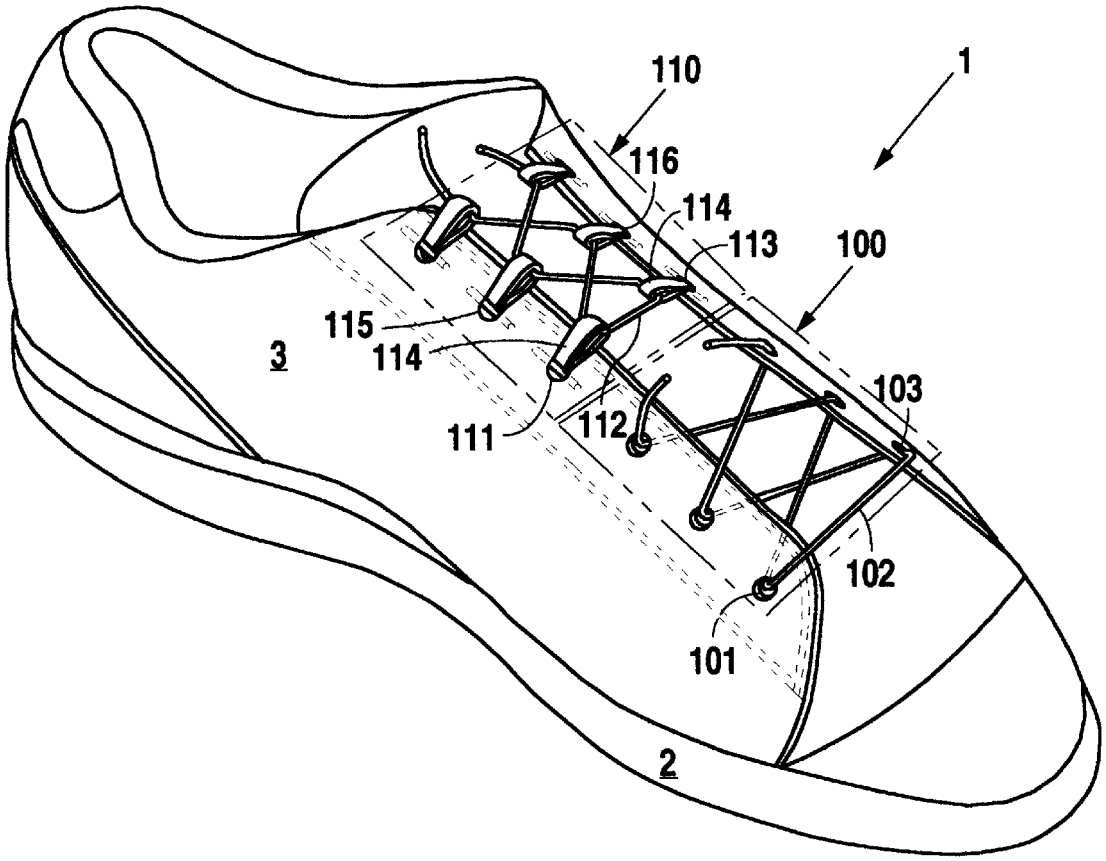
FIG. 1 is a perspective view of a piece of footwear (i.e., a shoe) incorporating a lace-binding system of the present invention in upper vamp sections; a typical lace-binding system is present in lower vamp sections.

FIG. 1 illustrates a shoe 1 having a sole 2 and an upper 3 secured to sole 2. Shoe 1 incorporates a lace-binding system of the present invention, identified by a box labeled with the number 110. Shoe 1 also incorporates a typical lace-binding system, identified by a box labeled with the number 100.

Figure 2:
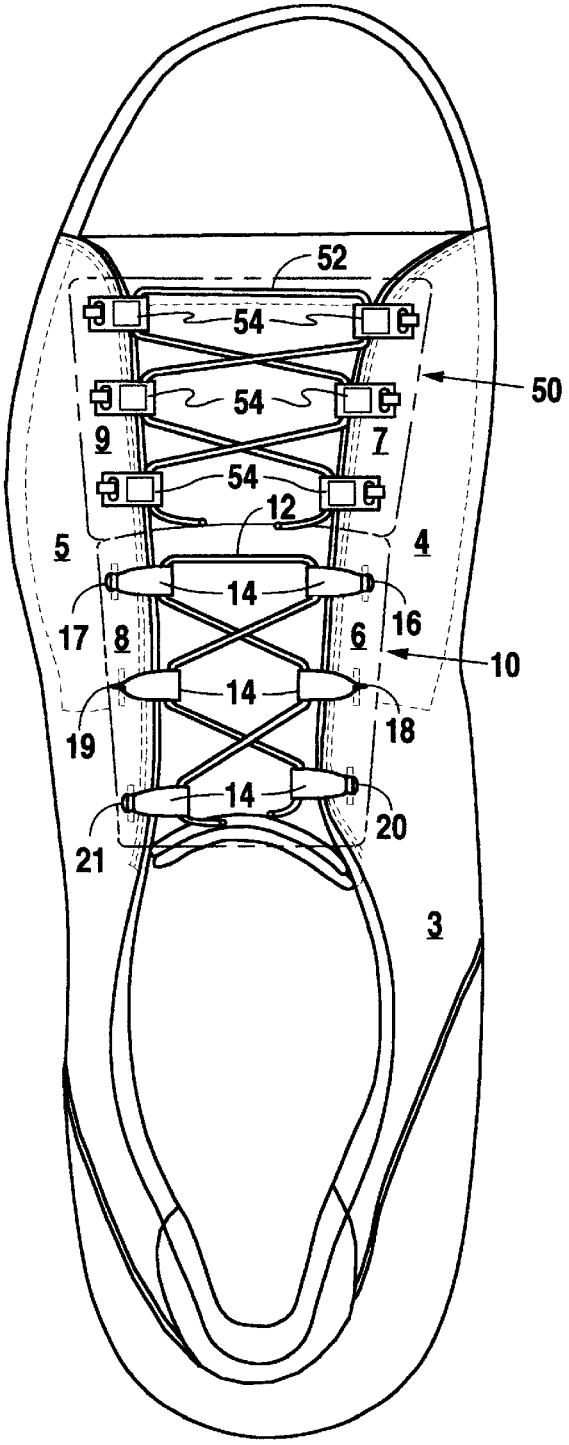
FIG. 2 is a top view of a shoe incorporating two lace-binding systems of the present invention, one in upper vamp sections and another in lower vamp sections, each system illustrating a different embodiment of eyelet extenders.

Referring to FIG. 2, upper 3 comprises medial vamp section 4 and lateral vamp section 5. Medial vamp section 4 comprises upper medial vamp section 6 and lower medial vamp section 7. Likewise, lateral vamp section 5 comprises upper lateral vamp section 8 and lower lateral vamp section 9. For either medial or lateral vamp sections, upper and lower vamp sections may be areas of a continuous piece or separate sections of a "split" vamp. Medial vamp section 4 and lateral vamp section 5 each have a plurality of eyelets or passages therethrough. FIG. 2 illustrates two lace-binding systems (i.e., shoelace-binding systems) of the present invention, each system illustrating a different embodiment of eyelet extenders.

Referring again to FIG. 2, one embodiment of a lace-binding system having eyelet extenders is identified by the box labeled with the number 10. Eyelet extenders of lace-binding system 10 are further depicted in FIGS. 3, 4, 5, and 6. Lace-binding system 10 for drawing together upper medial vamp section 6 and upper lateral vamp section 8 (or, more generally, medial vamp section 4 and lateral vamp section 5) comprises a plurality of eyelet extenders 14, each eyelet extender being positioned within one of the eyelets of vamp section 4 (e.g., eyelets 16, 18, or 20) or vamp section 5 (e.g., eyelets 17, 19, or 21). Tightening lace 12 between eyelet extenders 14 in the eyelet line of eyelets 16, 18, and 20 of upper medial vamp section 6 and eyelet extenders 14 in the eyelet line of eyelets 17, 19 and 21 of upper lateral vamp section 8 draws together medial vamp section 4 and lateral vamp section 5 (or, more particularly, upper medial vamp section 6 and upper lateral vamp section 8).

Figure 3:
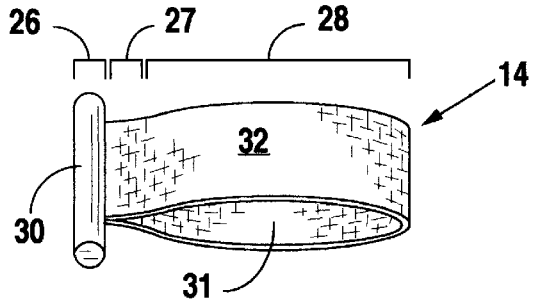
FIG. 3 is a perspective view of one embodiment of a lace-binding system eyelet extender having a flexible loop for receiving lace.
Figure 4:
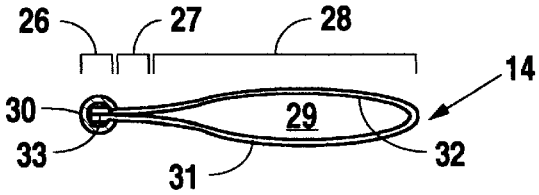
FIG. 4 is an enlarged side view of the eyelet extender of FIG. 3.
Figure 5:
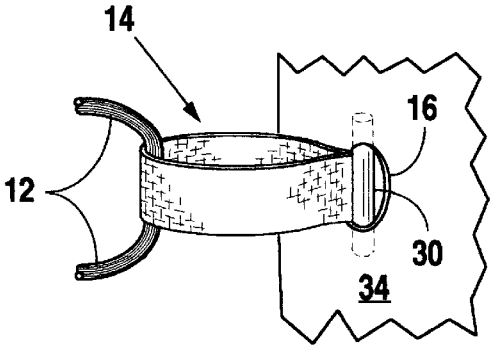
FIG. 5 is a top view of the eyelet extender of FIGS. 3 and 4 in the lower eyelet of the upper medial vamp section of the shoe of FIG. 2.

Referring to FIGS. 3 and 4, eyelet extender 14 comprises sub-eyelet section 26 for removably retaining eyelet extender 14 within an eyelet, supra-eyelet section 28 having a passage 29 therethrough for receiving a lace, and eyelet traversing section 27 joining sub-eyelet section 26 and supra-eyelet section 28.

Referring to FIGS. 2, 3, 4, 5, and 6, eyelet extender 14 further comprises sub-eyelet section 26, eyelet-traversing section 27, and supra-eyelet section 28, wherein: eyelet-traversing section 27, at one end, joins sub-eyelet section 26; eyelet-traversing section 27, at an opposite end, joins supra-eyelet section 28; sub-eyelet section 26 comprises rod-shaped anchor 30 for removably retaining eyelet extender 14 within eyelets of upper vamp sections 6 and 8 (such as eyelets 16–21); and supra-eyelet section 28 has passage 29 therethrough for receiving lace 12.

Referring to FIGS. 3, 4, 5, and 6, rod-shaped anchor 30 of sub-eyelet section 26 is joined to a flexible loop of colored material (e.g. a fabric such as nylon of a strong weave) to form eyelet extender 14. The flexible loop of colored material forms eyelet-traversing section 27 and supra-eyelet section 28; the two sections are continuous. Rod-shaped anchor 30 of sub-eyelet section 26 is constructed from a rectangular metal piece using manufacturing procedures known to those of skill in light of the present disclosure, and, with continued use of such procedures, rolled and joined onto the two layers of the flexible loop, depicted as lower layer 31 and upper layer 32. The joined metal piece forms rod-shaped anchor 30. Almost all of the flexible loop of colored material forming eyelet-traversing section 27 and supra-eyelet section 28 falls outside the interior of rod-shaped anchor 30, though portions 33 of the flexible loop are within rod-shaped anchor 30. Portions 33 may constitute separate ends of the colored material, or may be part of an unbroken belt continuous with the flexible loop of colored material exterior to rod-shaped anchor 30.

While in this example, rod-shaped anchor 30 of sub-eyelet section 26 is constructed from a rectangular metal piece, it is to be understood that rod-shaped anchor 30, in other embodiments, may be constructed of plastic, graphite, wood, or other materials. Similarly, it is to be understood that the flexible loop forming eyelet-traversing section 27 and supra-eyelet section 28 may be constructed, in other embodiments, of materials other than a fabric. In addition, both rod-shaped anchor 30 and the flexible loop extending from it may be formed from the same material (e.g., a plastic) using methods known to those of skill in the art in light of the present disclosure. In such an embodiment, sub-eyelet section 26, including rod-shaped anchor 30, is continuous with the flexible loop that forms both eyelet-traversing section 27 and supra-eyelet section 28. Consequently, an eyelet extender is formed in which each section (i.e., sub-eyelet, eyelet-traversing, and supra-eyelet) is continuous with another. In another embodiment, the flexible loop of eyelet extender 14 is made of, rather than, for example, a fabric of a strong weave, a stretchable material (e.g. a synthetic rubber) using methods known to those of skill in the art in light of the present disclosure. The length, flexibility, and elasticity of the stretchable material may be used to facilitate modifying flexibility between eyelets and lace, accommodating, to a comfortable level of snugness, constancy in the path length of lace in lace-binding systems. The flexible loop of eyelet extender 14 may not only be of different colors, and not only vary in length, flexibility, and elasticity, but material of the flexible loop may also vary in texture, e.g., from having an uneven surface texture on one hand to being smooth in appearance on the other hand.

Referring to FIGS. 2, 3, 4, and 5, eyelet extender 14 is preferably placed in eyelet 16 (which, like eyelet 20, is circular in form) by inserting through eyelet 16, from a supra-eyelet position, one end of rod-shaped anchor 30. In inserting one end of rod-shaped anchor 30 through eyelet 16, part of the flexible loop (i.e., of eyelet-traversing section 27) of colored material is also drawn into eyelet 16. Inserting rod-shaped anchor 30 into eyelet 16 is continued until both ends of rod-shaped anchor 30 are inserted through eyelet 16. With both ends of rod-shaped anchor 30 in a sub-eyelet position, the part of the flexible loop of colored material that is in a supra-eyelet position is pulled in order to position both end extensions of rod-shaped anchor 30 in contact with, or adjacent to, material that surrounds eyelet 16. In one particular embodiment, end extensions of rod-shaped anchor 30 would contact, or be adjacent to, the underside of material 34 of upper medial vamp section 6 immediately surrounding eyelet 16. By such a method, eyelet extender 14 in eyelet 16 is inserted and removably retained in upper medial vamp section 6.

Figure 6:
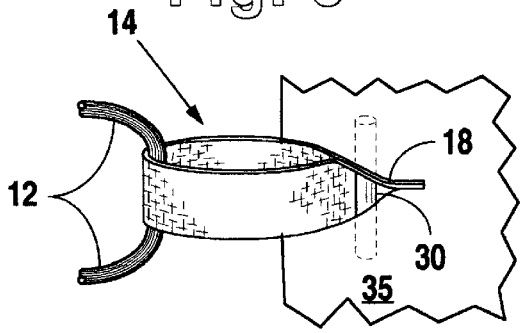
FIG. 6 is a top view of the eyelet extender of FIGS. 3 and 4 in the intermediate eyelet of the upper medial vamp section of the shoe of FIG. 2.

Referring to FIGS. 2, 3, 4, and 6, eyelet 18 in upper medial vamp section 6 and eyelet 19 in upper lateral vamp section 8 each display another optional feature: each of these eyelets is in the form of a upper-to-sole-oriented slit. Referring to FIG. 6, rod-shaped anchor 30 of eyelet extender 14 may be inserted through eyelet 18 in a similar upper-to-sole orientation, and, after being inserted, twisted within eyelet 18 ninety degrees in order to assume an orientation amenable for, referring also to FIG. 4, passage 29 of supra-eyelet section 28 to receive lace 12 of lace-binding system 10. After being twisted, rod-shaped anchor 30 is oriented at approximately a right angle to the upper-to-sole-oriented slit of eyelet 18, a position in which rod-shaped anchor 30 would retain, albeit removably, eyelet extender 14 in upper medial vamp section 6. A reenforcement or backing piece made of fabric, metal, sturdy plastic, fibrous composite material, or other material may provide support beneath material 35 that surrounds eyelet 18 in order to compensate for the potential propensity of the slit's upper-to-sole orientation to weaken the capacity of rod-shaped anchor 30 to retain eyelet extender 14 within eyelet 18 of upper medial vamp section 6.

After eyelet extenders 14 are inserted and removably retained within eyelets of upper vamp sections 6 and 8 (i.e., within eyelets 16–21), lace 12 is threaded through passages 29 within supra-eyelet sections of each eyelet extender 14 to form lace-binding system 10. In a preferred embodiment, threading of lace 12 through each eyelet extender 14 is in a criss-cross fashion, so that lace 12 is arranged within lace-binding system 10 as shown in FIG. 2.

Referring again to FIG. 2, a lace-binding system with a different embodiment of eyelet extenders is identified by the box labeled with the number 50. Components of an eyelet extender of lace-binding system 50 are further depicted in FIG. 7, while a side view of an eyelet extender of lace-binding system 50, in a vamp section, is depicted in FIG. 8.

Referring to FIG. 2, lace-binding system 50 for drawing together lower medial vamp section 7 and lower lateral vamp section 9 (or, more generally, medial vamp section 4 and lateral vamp section 5) comprises a plurality of eyelet extenders 54, each eyelet extender being positioned within one of the eyelets of lower vamp sections 7 and 9. Tightening lace 52 between eyelet extenders 54 in the eyelet line of eyelet 16, but of lower medial vamp section 7, and eyelet extenders 54 in the eyelet line of eyelet 17, but of lower lateral vamp section 9, draws together medial vamp section 4 and lateral vamp section 5 (or, more particularly, lower medial vamp section 7 and lower lateral vamp section 9).

Figure 8:
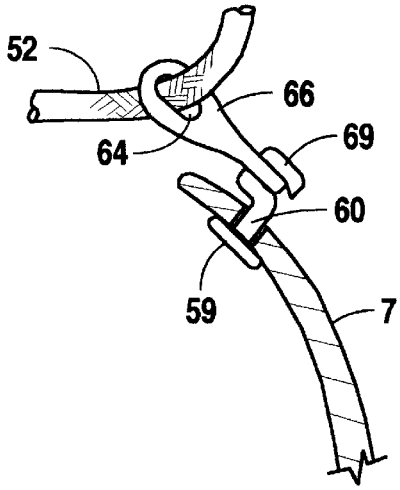
FIG. 8 is a side view of the components of FIG. 7 joined to form an eyelet extender in the lower medial vamp section of the shoe of FIG. 2.
Figure 7:
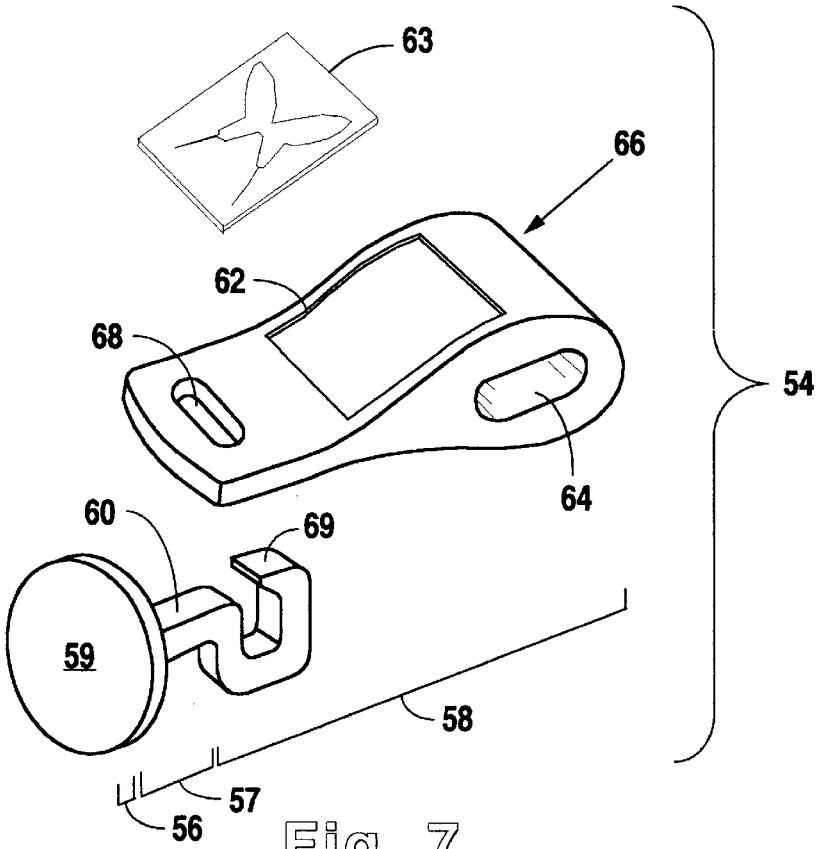
FIG. 7 is a perspective view of components of an embodiment of a lace-binding-system eyelet extender.

Referring to FIGS. 2, 7, and 8, components of eyelet extender 54 further comprise sub-eyelet section 56, eyelet-traversing section 57, and supra-eyelet section 58, wherein: eyelet-traversing section 57, at one end, joins sub-eyelet section 56; eyelet-traversing section 57, at an opposite end, joins supra-eyelet section 58; sub-eyelet section 56 comprises a plate-shaped anchor 59 (having an eyelet-crossing diameter greater than diameters of the eyelets of vamp sections 4 and 5) for removably retaining eyelet extenders 54 in vamp sections 4 and 5 (or, more particularly, lower vamp sections 7 and 9); supra-eyelet section 58 receives lace 52 through passage or channel 64 of tab 66 of supra-eyelet section 58.

Eyelet extender 54 is preferably formed from sturdy plastic material using manufacturing procedures known to those of skill in the art in light of the present disclosure. Tab 66 of supra-eyelet section 58 has opening 68 at one end for receiving hook 69 of the non-tab part of supra-eyelet section 58 that is continuous with eyelet-traversing section 57. At an opposite end, tab 66 of supra-eyelet section 58 has lace-receiving passage or channel 64. The circumferences of both lace-receiving channel 64 and opening 68 are similar, and both are roughly oval in shape, in this particular embodiment. Furthermore, neck 60, in this particular embodiment, extends in continuity from plate-shaped anchor 59 of sub-eyelet section 56.

Eyelet extender 54 is preferably placed in an eyelet by inserting through the eyelet, from a sub-eyelet position, hook 69 of supra-eyelet section 58 without tab 66 being linked thereto. Hook 69 is pulled through the eyelet so that plate-shaped anchor 59 of sub-eyelet section 56 is positioned below the eyelet as an anchor in contact with, or adjacent to, material that surrounds the eyelet. Tab 66 of supra-eyelet section 58 is linked, i.e., joined, through opening 68 to hook 69. Because the diameter of plate-shaped anchor 59 is greater than the eyelet diameter, sub-eyelet section 56 retains, albeit removably, eyelet extender 54 in an eyelet of a vamp section. For example, in FIG. 8, plate-shaped anchor 59 removably retains in an eyelet of lower lateral vamp section 7 an eyelet extender of lace-binding system 50. In joining tab 66 and hook 69 of supra-eyelet section 58 at opening 68, tab 66 is positioned so that a decal-receiving depression 62 on tab 66 is oriented upward, i.e., so that decal 63, when applied in decal-receiving depression 62, is maximally visible.

After eyelet extenders 54 are removably retained within eyelets of lower vamp sections 7 and 9, lace 52 is threaded through each passage or channel 64 in eyelet extenders 54 in order to form lace-binding system 50. In a preferred embodiment, threading of lace 52 through each eyelet extender 54 is in a criss-cross fashion, so that lace 52 is arranged within lace-binding system 50 as shown in FIG. 2.

Figure 9:
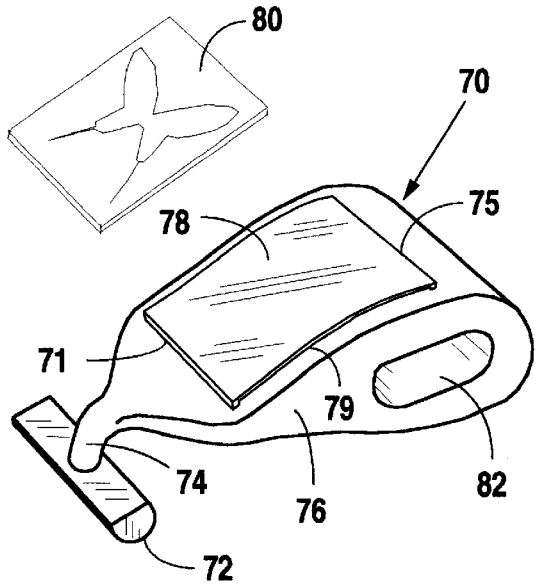
FIG. 9 is a perspective view of an embodiment of a lace-binding-system eyelet extender.
Figure 10:
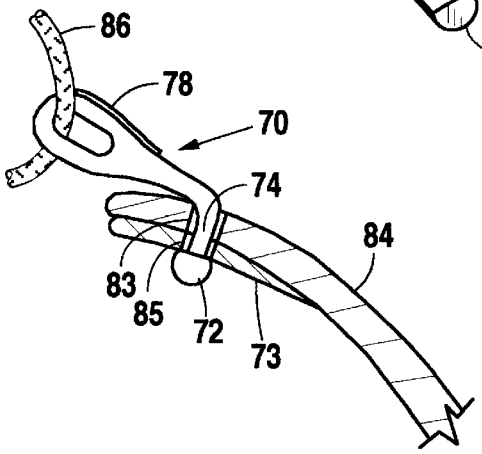
FIG. 10 is a side view of the eyelet extender of FIG. 9 in a shoe vamp section.

Referring to FIGS. 9 and 10, another embodiment of an eyelet extender in which each eyelet extender section (i.e., sub-eyelet, eyelet-traversing, and supra-eyelet) is continuous with another section is identified with the number 70. Eyelet-traversing section 74 is continuous, at one end, with sub-eyelet anchor 72, and, at its other end, with supra-eyelet section 76. On the topside of supra-eyelet section 76 is a raised transparent window 78 into which an insert 80 may be placed through an edge. In this particular embodiment, raised transparent window 78 has at least two edges, such as edges 71 and 75, that are secured to supra-eyelet section 76; insert 80 may be placed under raised transparent window 78 through a free edge, such as edge 79. Lace-receiving channel 82 provides a passage through one end of supra-eyelet section 76 for receiving a lace 86. In this particular embodiment, the end of supra-eyelet section 76 around lace-receiving channel 82 is about four times thicker than the end continuous with the neck of eyelet-traversing section 74. Furthermore, in this particular embodiment, eyelet-traversing section 74 extends from sub-eyelet section 72 as a circular column or neck. The shapes of supra-eyelet section 76 and eyelet-traversing section 74 may vary greatly in other embodiments.

In the particular embodiment depicted in FIGS. 9 and 10, the neck of the eyelet-traversing section 74 is angled near its juncture with the supra-eyelet section 76. In other embodiments, the eyelet-traversing section or the supra-eyelet section may be angled elsewhere—e.g., at the mid-point of the eyelet-traversing section, or in the supra-eyelet section near its juncture with the eyelet-traversing section. In all angled embodiments, however, eyelet-traversing section 74 is angled with respect to supra-eyelet section 76.

Referring to FIG. 10, eyelet extender 70 is in place in both eyelet 83 of vamp section 84 and opening 85 of reenforcement or backing piece 73. Reenforcement or backing piece 73 may be made of various materials, including, without limitation, fabric, metal, plastic, or a fibrous composite material. End extensions of rod-shaped anchor 72 contact, or are adjacent to, material of reenforcement or backing piece 73 beneath vamp section 84 and eyelet 83, removably retaining eyelet extender 70 in eyelet 83 of vamp section 84. Eyelet extender 70 is placed in eyelet 83 preferably by inserting through eyelet 83 and opening 85 from a supra-eyelet position, an end extension of rod-shaped anchor 72. The other end extension of rod-shaped anchor 72 is subsequently inserted through eyelet 83 and opening 85 so that the end extensions of rod-shaped anchor 72 are in contact with, or adjacent to, material of reenforcement or backing piece 73 beneath vamp section 84 and eyelet 83. An upper-oriented surface of rod-shaped anchor 72 is flattened to make more secure its contact, or adjacency, with reenforcement or backing piece 73 beneath vamp section 84.

Referring to FIGS. 9 and 10, rod-shaped anchor 72 is inserted so that insert-receiving, transparent window 78 is positioned to be oriented upward, i.e., so that insert 80 is maximally visible when eyelet extender 70 is in place in eyelet 83. After eyelet extenders 70 are removably retained in place in eyelets of a vamp section or sections, lace 86 is threaded through lace-receiving passage or channel 82 of each eyelet extender in order to form a lace-binding system.

Referring to FIGS. 11–14, several views of another embodiment of an eyelet extender in which each eyelet extender section (i.e., sub-eyelet section 92, eyelet-traversing section 94, and supra-eyelet section 96) is continuous with another section is identified with the number 90. Supra-eyelet section 96 of eyelet extender 90 in this particular embodiment has an uneven surface texture of lightly-etched cross-hatching on front surface 91 and a smoother surface texture on rear surface 92. Eyelet extender 90, in which all three sections (i.e., sub-eyelet section 92, eyelet-traversing section 94, and supra-eyelet section 96) are largely in a single plane, is preferably formed from sturdy, albeit somewhat pliable, plastic material using manufacturing procedures known to those of skill in the art in light of the present disclosure. Furthermore, ends of sub-eyelet section 92 are preferably beveled to facilitate insertion of eyelet extender 90 into an eyelet. Ends of sub-eyelet section 92 may also be beveled so that the more downward region of the bevel is narrower than the more upward region, so as to make insertion of eyelet extender 90 into an eyelet potentially easier than its removal. A notch or hinge 93 is formed in the sub-eyelet section 92 of eyelet extender 90. The pliability of the plastic of eyelet extender 90 allows end extensions of sub-eyelet section 92 to be compressed toward each other in closing notch or hinge 93. This pliability also allows the ends of sub-eyelet section 92 to be separated in opening notch or hinge 93.

Either closing or opening notch or hinge 93 may facilitate placing eyelet extender 90 in an eyelet, or removing it from an eyelet. The placement and removal of eyelet extender 90 as part of a lace-binding system is otherwise accomplished in a manner similar to that described in connection with extender 70. After insertion into an eyelet, end extensions of rod-shaped anchor 92 contact, or are adjacent to, material beneath a vamp section, removably retaining eyelet extender 90 in an eyelet of a vamp section. After eyelet extenders 90 are removably retained in eyelets of a vamp section or sections, lace is threaded through lace-receiving channel 95 of each eyelet extender in order to form a lace-binding system.

Figure 11:
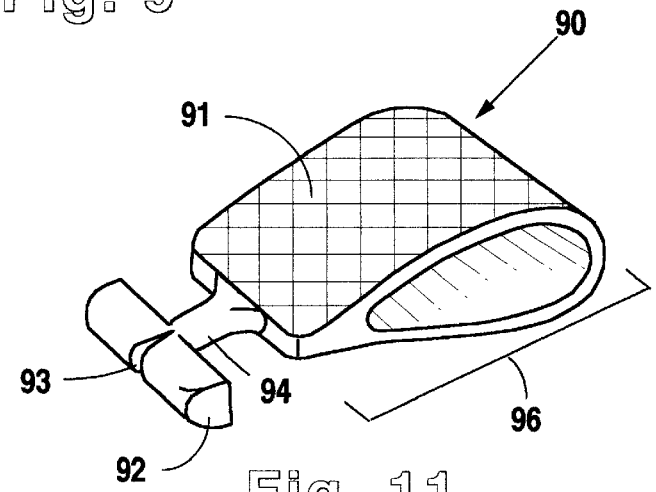
FIG. 11 is a perspective view of an embodiment of a lace-binding-system eyelet extender in which a notch or hinge is formed in the sub-eyelet section.
Figure 12:
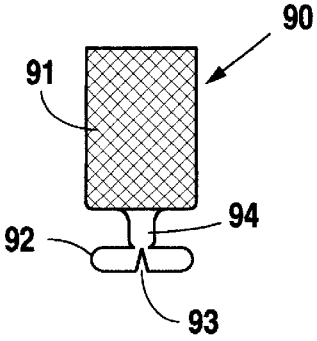
FIG. 12 is a front plan view of the eyelet extender of FIG. 11.
Figure 13:
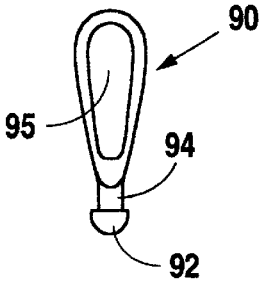
FIG. 13 is a side view of the eyelet extender of FIG. 11.
Figure 14:
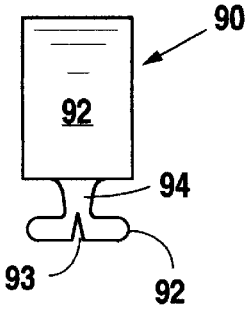
FIG. 14 is a rear plan view of the eyelet extender of FIG. 11.

Referring to FIGS. 11, 12, and 14, while a single notch or hinge 93 is depicted in this particular embodiment as being located in the middle of sub-eyelet section 92, the number, locations, and kinds of notches or hinges may vary in other embodiments. For example, two or more notches may be present in a sub-eyelet section at locations other than the middle of the sub-eyelet section in some embodiments. As another example, a sub-eyelet section may comprise an anchor having actual interlocking hinge mechanisms, the hinge mechanisms allowing the sub-eyelet section to be locked to material surrounding, or adjacent to, an eyelet, in other embodiments. As another example, a visible notch in the sub-eyelet section may be absent in other embodiments, but a hinge may be regarded as being present nonetheless, the hinge being an area of considerable pliability in the sub-eyelet section. It should also be understood that notches or hinges are not limited to being present in embodiments of replaceable eyelet extenders depicted in FIGS. 11–14, but may be present in the sub-eyelet extenders of other embodiments of replaceable eyelet extenders, such as, for example, those depicted in FIGS. 1–10.

Referring to FIGS. 1, 2, 5, 6, 8, and 10 (and particularly FIG. 10) the retaining, albeit removably, of eyelet extenders in vamp sections by sub-eyelet sections (like the sub-eyelet section having rod-shaped anchor 72) may be augmented or re-enforced by a reenforcement or backing piece (like reenforcement or backing piece 73) located between vamp material on an upper side (like vamp section 84) and a sub-eyelet section anchor (like rod-shaped anchor 72) on a lower side. The retaining, albeit removably, of eyelet extenders of embodiments other than the one depicted in FIG. 10 (for example, eyelet extender embodiments of FIGS. 3–8 and 11–14) may be similarly augmented or re-enforced by a reenforcement or backing piece. Furthermore, a reenforcement or backing piece may align along an eyelet line, re-enforcing the retaining, albeit removably, of all eyelet extenders in the eyelet line.

Referring to FIGS. 1 and 3, a lace-binding system that lacks eyelet extenders is identified by the box labeled with the number 100. Imagining lace 102 of lace-binding system 100 to be absent, the present invention provides a method of introducing a color pattern in footwear having eyelets (such as eyelets of the eyelet lines containing eyelets 101 and 103), but lacking lace and eyelet extenders. The present invention also provides, a method of introducing flexibility between eyelets and lace for such footwear having eyelets, but which yet, lacks lace and eyelet extenders. The method of introducing a color pattern comprises: placing eyelet extenders in eyelets (such as eyelets of the eyelet lines containing eyelets 101 and 103) so that each eyelet extender is removably retained and oriented to receive lace; and threading lace through supra-eyelet sections of the eyelet extenders. The method of introducing flexibility for such footwear comprises: placing eyelet extenders in the eyelets (such as eyelets of the eyelet lines containing eyelets 101 and 103) so that each eyelet extender is removably retained and oriented to receive lace; and threading lace through supra-eyelet sections of the eyelet extenders.

Referring again to FIG. 1, a lace-binding system that has eyelets and lace, but that lacks eyelet extenders, is identified by the box labeled with the number 100. In a related aspect, the invention also provides a method of modifying a color pattern in footwear having such a lace-binding system that has eyelets and lace but lacks eyelet extenders, as well a method of modifying flexibility between eyelets and lace in such footwear. The method of modifying a color pattern comprises: removing lace (such as lace 102) threaded through eyelets (such as eyelets 101 and 103); placing eyelet extenders in one or more eyelets (such as eyelets 101 and 103) so that each eyelet extender is removably retained in an eyelet and oriented to receive lace; and threading lace through supra-eyelet sections of the eyelet extenders. The method of modifying flexibility between eyelets and lace in such footwear comprises: removing lace (such as lace 102), threaded through eyelets (such as eyelets 101 and 103); placing eyelet extenders in one or more of the eyelets (such as eyelets 101 and 103) so that each eyelet extender is removably retained in an eyelet and oriented to receive lace; and threading lace through supra-eyelet sections of the eyelet extenders.

Referring again to FIG. 1, a lace-binding system with replaceable eyelet extenders is identified by the box labeled with the number 110. In another related aspect, the invention also provides a method of modifying a color pattern in footwear having a lace-binding system with replaceable eyelet extenders, as well as a method of modifying flexibility between eyelets and lace in such footwear. The method of modifying a color pattern comprises: removing lace (such as lace 112) threaded through eyelet extenders (such as eyelet extenders 114); removing one or more eyelet extenders (such as eyelet extenders 114) in eyelets (such as eyelets 111, 113, 115, and 116); replacing the one or more removed eyelet extenders (such as eyelet extenders 114) in the eyelets (such as eyelets 111, 113, 115, and 116) with replacement eyelet extenders of colors different than the one or more removed eyelet extenders (such as eyelet extenders 114), so that each replacement eyelet extender is removably retained in an eyelet (such as eyelet 111 for one replacement eyelet extender, eyelet 113 for another replacement eyelet extender, eyelet 115 for another replacement eyelet extender, and eyelet 116 for another replacement eyelet extender) and oriented to receive lace; and threading lace through supra-eyelet sections of the replacement eyelet extenders.

The method of modifying flexibility between eyelets and lace in such footwear comprises: removing lace (such as lace 112) threaded through eyelet extenders (such as eyelet extenders 114); removing one or more eyelet extenders (such as eyelet extenders 114) in eyelets (such as eyelets 111, 113, 115, and 116); replacing the one or more removed eyelet extenders (such as eyelet extenders 114) in said eyelets (such as eyelets 111, 113, 115, and 116) with replacement eyelet extenders of a different length, flexibility, or elasticity than the one or more removed eyelet extenders (such as eyelet extenders 114) so that each replacement eyelet extender is removably retained in an eyelet (such as eyelet 111 for one replacement eyelet extender, eyelet 113 for another replacement eyelet extender, eyelet 115 for another replacement eyelet extender, and eyelet 116 for another replacement eyelet extender) and oriented to receive lace; and threading lace through supra-eyelet sections of the replacement eyelet extenders.

For either the method of modifying a color pattern or the method of modifying flexibility between eyelets and lace in footwear having a lace-binding system with replaceable eyelet extenders, the removing of a component of an eyelet extender in an eyelet is understood to remove the eyelet extender from the eyelet, and the replacement of an eyelet extender component to form an eyelet extender in an eyelet is understood to place a replacement eyelet extender in the eyelet. Accordingly, either the method of modifying a color pattern or the method of modifying flexibility between eyelets and lace in footwear having a lace-binding system with replaceable eyelet extenders may be accomplished using components of replaceable eyelet extenders.

Methods of modifying a texture pattern in footwear having a lace-binding system with replaceable eyelet extenders are analogous to methods of modifying a color pattern in such footwear, except that removed eyelet extenders are of one texture and replacement eyelet extenders are of a texture different than the removed eyelet extenders. Methods of modifying a texture pattern in footwear having a lace-binding system with replaceable eyelet extenders may also be accomplished using components of replaceable eyelet extenders.

Referring again to FIG. 2, in another related aspect, the invention also provides a lace-binding system comprising a lace (such as lace 12) from a first piece (such as eyelet extender 14 in eyelet 16), an eyelet (such as eyelet 17) in a second piece (such as upper lateral vamp section 8), and an eyelet extender (such as eyelet extender 14 in eyelet 17) joining the lace (such as lace 12) from the first piece (such as eyelet extender 14 in eyelet 16) and the eyelet (such as eyelet 17) in the second piece (such as upper lateral vamp section 8), the eyelet extender (such as eyelet extender 14 in eyelet 17) comprising, referring to FIGS. 3 and 4, a sub-eyelet section 26, an eyelet traversing section 27, and a supra-eyelet section 28, wherein: the eyelet-traversing section 27 joins at one end the sub-eyelet section 26; the eyelet-traversing section 27 at an opposite end joins the supra-eyelet section 28; the sub-eyelet section 26 comprises an anchor 30 for removably retaining, referring again to FIG. 2, the eyelet extender (such as eyelet extender 14 in eyelet 17) to the second piece (such as upper lateral vamp section 8); the supra-eyelet section receives lace (such as lace 12) from the first piece (such as eyelet extender 14 in eyelet 16); and drawing a length of the lace (such as lace 12) between the first piece (such as eyelet extender 14 in eyelet 16) and the eyelet extender (such as eyelet extender 14 in eyelet 17) acts to draw the second piece (such as upper lateral vamp section 8) toward the first piece (such as eyelet extender 14 in eyelet 16).

Referring to FIGS. 1–14, it is to be understood that dimensions for embodiments of eyelet extenders of the present invention may vary greatly. Scales of particular embodiments depicted may be better appreciated by noting nonetheless that, in the particular embodiment of eyelet extender 14 depicted in FIG. 3, the flexible loop or colored material measures about 50 mm in circumference, about 8–10 mm in width, and about 0.5 mm in thickness. Furthermore, rod-shaped anchor 30 of eyelet extender 14 measures about 12–13 mm in length. In the particular embodiment of eyelet extender 54 depicted in FIG. 7, tab 66 of supra-eyelet section 58 measures about 17 mm in length, about 11 mm in width, and about 1–2 mm in thickness at its thin end to about 6 mm in thickness at its thick end. Plate anchor 59 of sub-eyelet section 56 measures about 8–10 mm in diameter and about 1–2 mm in thickness. In the particular embodiment of eyelet extender 70 depicted in FIG. 9, supra-eyelet section 76 measures about 12 mm in length, about 10 mm in width, and about 1–2 mm in thickness at its thin end to about 6 mm in thickness at its thick end. Rod-shaped anchor 72 measures 10 mm in length and about 2 mm in thickness. Dimensions of the particular embodiment of eyelet extender 90 depicted in FIG. 11 are approximately the same as those of the embodiment of eyelet extender 70 depicted in FIG. 9.

Referring again to FIG. 2, while footwear having two lace-binding systems per shoe is depicted, it is to be understood that the present invention includes footwear having one lace-binding system (with replaceable eyelet extenders) per shoe, as well as footwear having two or more lace-binding systems (with replaceable eyelet extenders) per shoe. Furthermore, it is to be understood that, while a shoe for a left foot is depicted in FIG. 2 (as well as FIG. 1), the present invention includes not only footwear for a left foot, but also footwear for a right foot, having a lace-binding system with replaceable eyelet extenders. In addition, it is to be understood that a lace-binding system may utilize eyelet extenders all of the same embodiment, or such a system may utilize various different embodiments of eyelet extenders in one lace-binding system. It is also to be understood that the present invention is not limited to footwear, but includes articles of manufacture other than footwear, including articles of apparel (e.g., leg covers, dresses, coats, etc.) and nonapparel (e.g., containers, boat covers, tents, etc.) having lace-binding systems with replaceable eyelet extenders.

While footwear of the present invention, i.e., footwear having a lace-binding system with replaceable eyelet extenders, has been described in connection with preferred embodiments, the invention is not intended to be limited to the particular embodiments described. On the contrary, the invention is intended to cover such alternatives, modifications, and equivalents as may be included with the spirit and scope of the invention as defined by the appended claims.

What is claimed is:

1. Footwear, comprising:

a sole;

an upper connected to said sole, said upper comprising a lateral vamp section and a medial vamp section and a plurality of eyelets in said vamp sections; and a lace-binding system for drawing said vamp sections together comprising a plurality of replaceable eyelet extenders, each of said eyelet extenders being positioned within one of said eyelets, said eyelet extender comprising a rod-shaped sub-eyelet section for removably retaining said eyelet extender within said eyelet, a supra-eyelet section having an enclosed passage therethrough for receiving a lace, and an eyelet traversing section joining said sub-eyelet section and said supra-eyelet section at approximately the mid-point of said sub-eyelet section, said sub-eyelet section having a length greater than a width of said eyelet, wherein said passage for receiving said lace is a channel of a tab of said supra-eyelet section and wherein said tab has a transparent window under which an insert may be placed.

2. Footwear, comprising:

a sole;

an upper connected to said sole, said upper comprising a lateral vamp section and a medial vamp section and a plurality of eyelets in said vamp sections; and a lace-binding system for drawing said vamp sections together comprising a plurality of replaceable eyelet extenders, each of said eyelet extenders being positioned within one of said eyelets, said eyelet extender comprising a rod-shaped sub-eyelet section for removably retaining said eyelet extender within said eyelet, a supra-eyelet section having an enclosed passage therethrough for receiving a lace, and an eyelet traversing section joining said sub-eyelet section and said supra-eyelet section at approximately the mid-point of said sub-eyelet section, said sub-eyelet section having a length greater than a width of said eyelet, wherein said passage for receiving said lace is a channel of a tab of said supra-eyelet section and wherein said tab has a transparent window under which an insert may be placed, and wherein a colored insert is under said transparent window.

3. Footwear, comprising:

a sole;

an upper connected to said sole, said upper comprising a lateral vamp section and a medial vamp section and a plurality of eyelets in said vamp sections; and a lace-binding system for drawing said vamp sections together comprising a plurality of replaceable eyelet extenders, each of said eyelet extenders being positioned within one of said eyelets, said eyelet extender comprising a rod-shaped sub-eyelet section for removably retaining said eyelet extender within said eyelet, a supra-eyelet section having an enclosed passage therethrough for receiving a lace, and an eyelet traversing section joining said sub-eyelet section and said supra-eyelet section at approximately the mid-point of said sub-eyelet section, said sub-eyelet section having a length greater than a width of said eyelet, wherein said eyelet-traversing section is angled with respect to said supra-eyelet section, wherein said eyelet-traversing section at one end is continuous with said sub-eyelet section, and, at its other end, said eyelet-traversing section is continuous with said supra-eyelet section, and wherein said passage for receiving said lace is a channel of a tab of said supra-eyelet section and said tab has a transparent window under which an insert may be placed.

4. Footwear, comprising:

a sole;

an upper connected to said sole, said upper comprising a lateral vamp section and a medial vamp section and a plurality of eyelets in said vamp sections; and a lace-binding system for drawing said vamp sections together comprising a plurality of replaceable eyelet extenders, each of said eyelet extenders being positioned within one of said eyelets, said eyelet extender comprising a rod-shaped sub-eyelet section for removably retaining said eyelet extender within said eyelet, a supra-eyelet section having an enclosed passage therethrough for receiving a lace, and an eyelet traversing section joining said sub-eyelet section and said supra-eyelet section at approximately the mid-point of said sub-eyelet section, said sub-eyelet section having a length greater than a width of said eyelet, wherein said eyelet-traversing section is angled with respect to said supra-eyelet section, wherein said eyelet-traversing section at one end is continuous with said sub-eyelet section, and, at its other end, said eyelet-traversing section is continuous with said supra-eyelet section, wherein said passage for receiving said lace is a channel of a tab of said supra-eyelet section and said tab has a transparent window under which an insert may be placed, and wherein a colored insert is under said transparent window.

5. An extender for a footwear eyelet, comprising:

a supra-eyelet section having an enclosed passage therethrough for receiving a lace, a rod-shaped sub-eyelet section, and a neck joining said supra-eyelet section and said sub-eyelet section, said neck joined at approximately the mid-point of said sub-eyelet section and generally perpendicular thereto, said sub-eyelet section having a length greater than a width of said eyelet, whereby said extender may be replaceably secured within said eyelet, and wherein said supra-eyelet section has a depressed area for receiving a decal, and wherein a decal occupies said depressed area.

* * * * *